US005667421A

United States Patent [19]

Uetake

[11] Patent Number: 5,667,421

[45] Date of Patent: Sep. 16, 1997

[54] TOY VEHICLE

[75] Inventor: Tsugio Uetake, Tokyo, Japan

[73] Assignee: Nikko Co., Ltd., Tokyo, Japan

[21] Appl. No.: 579,341

[22] Filed: Dec. 27, 1995

[30] Foreign Application Priority Data

Dec. 28, 1994 [JP] Japan ..... 6-328534

[51] Int. Cl.[6] ..... A63H 17/26; A63H 17/39

[52] U.S. Cl. ..... 446/470; 446/456

[58] Field of Search ..... 446/470, 456, 446/462, 435, 436, 454, 455, 465

[56] References Cited

U.S. PATENT DOCUMENTS

| | | | |
|---|---|---|---|
| 3,748,780 | 7/1973 | Glass et al. | 446/470 X |
| 4,141,256 | 2/1979 | Wilson et al. | 446/463 X |
| 4,244,144 | 1/1981 | Goldberg et al. | 446/470 X |
| 4,925,427 | 5/1990 | Wu | 446/470 X |
| 5,322,469 | 6/1994 | Tilbor | 446/470 X |

*Primary Examiner*—Mickey Yu

*Attorney, Agent, or Firm*—Young & Thompson

[57] ABSTRACT

A toy vehicle with a rear frame having rear tires, and a front frame having front tires, the front frame being retractably mounted for an expansion-and-contraction movement of the toy vehicle.

6 Claims, 12 Drawing Sheets

TOY VEHICLE

BACKGROUND OF TEE INVENTION

This invention relates to a toy vehicle which is capable of attractive traveling performances, and more particularly to a toy vehicle which exhibits a modification in the length of its body.

Various types of the toy vehicle have been known such as racing cars, track vehicles, buggy cars and a vehicle running on a water surface. Such vehicles were designed to have attractive shapes and to be capable of attractive traveling performances. However, no vehicle has been designed which is capable of exhibiting an attractive modification of its body or chassis when traveling.

SUMMARY OF THE INVENTION

Accordingly, it is an object of the present invention to provide a novel toy vehicle which is capable of exhibiting a modification in the length of its body.

It is a further object of the present invention to provide a toy vehicle which can automatically change the length of its body.

It is a still further object of the present invention to provide a toy vehicle in which a tail spoiler, a model engine and the like are provided on frames of the toy vehicle and go up and down simultaneously with a change in the length of the vehicle's body.

It is a still further object of the present invention to provide a toy vehicle which is capable of a modification to its wheelbase for optimal straight traveling performance and turning.

The above and other objects, features and advantages of the present invention will be apparent from the following descriptions.

In accordance with the invention, there is provided a toy vehicle comprising a rear frame being provided with rear tires, and a front frame being provided with front tires, the front frame being retractably mounted for a expansion-and-contraction movement of the toy vehicle.

It is preferred that one of the front or rear frame comprises a plurality of parts which are moved back and forth as a result of the expansion-and-contraction movement of a length of the toy vehicle.

It is preferred that a toy vehicle further comprise one or more protrusile members being provided to the front and/or the rear frame, and an up-and-down unit being provided to the front and/or the rear frame for up-and-down movement of the protrusile members.

It is preferred that the up-and-down movement unit be operated together with the back and forth movement of the front or rear frame to make the protrusile members spring out of the frames when the length of the toy vehicle is expanded and to make the protrusile members stow into the frames when the length of the toy vehicle is contracted.

It is preferred that a toy vehicle further comprise a tail spoiler being provided to the rear frame and an up-and-down movement unit being provided to the front and/or the rear frame for up-and-down movement of the tail spoiler.

It is preferred that the up-and-down movement unit be operated together with the back and forth movement of the front or the rear frame to make the tail spoiler spring out of the rear frame when the length of the toy vehicle is expanded and to make the tail spoiler stow into the rear frame when the length of the toy vehicle is contracted.

It is preferred that the tail spoiler be supported by an elastic member to spring it out of the rear frame and wherein the tail spoiler is stowed into the rear frame by the up-and-down movement means.

It is preferred that the up-and-down movement means comprise at least one arm, one end of which is pivotly attached to the rear frame for pivoting the arm on the one end, and the tail-spoiler is provided with a contact portion to come in contact with the other end of arm, wherein a pivot movement of the arm makes the tail spoiler go up and down.

It is preferred that the arms be provided to both sides of the rear frame, and the tail spoiler is provided with two legs for attachment to the rear frame, the two legs are provided with protrusion portions respectively for coming in contact with the one ends of the It is preferred that the toy vehicle further comprise the arm comprising a first and a second arms, one end of which is pivotly attached to the rear frame for a pivot movement of the arms on the one end, wherein the other end of the first arm is in contact with the second arm and the other end of the second arm is in contact with the contact portion of the tail spoiler, thereby pivoting the second arm on one end together with a pivot movement of the first arm to make the tail spoiler go up and down.

It is preferred that the toy vehicle further comprise a protrusion being provided to the arm to come in contact with a rear end of the front frame, thereby .pivoting the arm on one end together with the forward and backward movement of the first frame.

It is preferred that the toy vehicle further comprise a protrusion being provided to the first arm to come in contact with a rear end of the front frame, thereby pivoting the first arm on one end together with the forward and backward movement of the first frame.

It is preferred that the toy vehicle further comprise a model engine being provided to the front or rear frame and an up-and-down movement unit being provided to the frame for an up-and-down movement of the engine.

It is preferred that the up-and-down movement unit be operated together with the back and forth movement of the front or rear frame to make the engine spring out of the frames when the toy vehicle is expanded and to make the engine stow into the frames when the length of the toy vehicle is contracted.

It is preferred that the toy vehicle further comprise an engine chamber being provided to the front frame for taking in the engine, an elastic member being provided in the chamber for supporting the engine and an arm being provided to the frame for stowing the arm into the engine chamber against elastic force of the elastic member.

It is preferred that the toy vehicle further comprise a contact portion being provided to the arm for stowing the engine into the engine chamber when the contact portion comes in contact with the rear frame.

It is preferred that the toy vehicle further comprise an air-intake being provided to the front and rear frames, the air-intake being expandable together with the back-and-forth movement of the front or rear frame.

It is preferred that one end of the air-intake is attached to the front frame and the other end is attached to the rear frame being provided with a chamber to take in the air-intake.

It is preferred that the toy vehicle further comprise a first drive unit being provided with the frame for driving the front and/or the rear tires.

It is preferred that the toy vehicle further comprise a coupling unit being provided between the front and the rear frames and a second drive unit being provided to the coupling means for driving the coupling unit.

It is preferred that the toy vehicle further comprise a first drive unit being provided with the frame for driving the front and/or the rear tire, a coupling unit being provided between the front and the rear frames and a second drive unit being provided to the coupling unit for driving the coupling unit.

It is preferred that the coupling unit comprise at least one gear being engaged with the second drive unit and a rack being engaged with the gear, wherein the gear is provided to the front or the rear frame and the rack is provided to the other.

It is preferred that the coupling unit further comprise a feed screw being engaged with the second drive unit and a female screw corresponding to the feed screw, the feed screw is provided to one of the front and rear frames and the female screw is provided to the other.

It is preferred that the second drive unit is engaged with the coupling means through the gear.

It is preferred that the gear further include a clutch structure for preventing the gear from being damaged upon a collision with an obstacle when the toy vehicle is in a expanded condition.

It is preferred that the structure further comprises a first and a second gears, the first gear is provided with a disk-like convex portion at its center axis and recess portions being provided around the disk-like convex portion, the second gear is provided with a concave portion into which the disk-like convex portion is engaged and protrusions being provided around the concave portion.

It is preferred that the disk-like convex portion of the first gear is engaged into the convex portion of the second gear and simultaneously the protrusions of the second gear are engaged into the recess portions of the first gear, in which the first and second gears operate as normal gears when the front or rear frame is moved back and forth, and the protrusions of the second gear are dislocated from the recess portions of the first gear to enter into idling state when force which stows one of the front and the rear frames into the other is added to the toy vehicle in the contraction condition.

It is preferred that the toy vehicle further comprise a control unit being provided to the frame for control of the drive units.

It is preferred that outputs of the control unit further consist of a first signal for control of the first drive unit, a second signal for control of the second drive unit and a third signal for control of a third drive unit which steers the front tires.

It is preferred that the control unit is provided with means for detecting a position of one of the front and rear frames which moves back and forth.

It is preferred that the detecting means supply a signal for stopping the back and forth movement of one of the front and rear frames when one of the front and rear frames reaches the predetermined positions.

It is preferred that the detecting means further comprises at least two protrusions and a switch which comes in contact with the protrusions, the protrusions are provided apart from each other to one of the front and rear frames, the switch is provided to one of the front and rear frames in which the switch can come in contact with the protrusions.

It is preferred that the control unit be a switch simply turning the drive unit on or off.

It is preferred that the control unit operate by receiving a radio-control signal for controlling the drive units.

It is preferred that the control unit operate by receiving a wire-remote-control signal for controlling the drive units.

BRIEF DESCRIPTION OF THE DRAWINGS

Preferred embodiments of the present invention will hereinafter fully be described in detail with reference to the accompanying drawings.

PREFERRED EMBODIMENTS OF THE INVENTION

A first embodiment of a toy vehicle according to the present invention will be described with reference to drawings.

Figure 1:
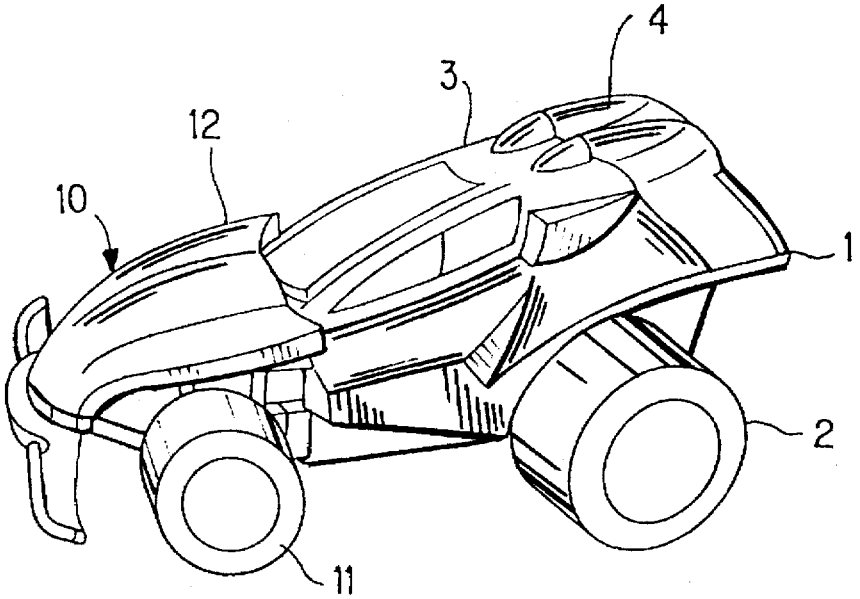
FIG. 1 is a perspective view showing a toy vehicle in the contracted condition in a first embodiment according to the invention.
Figure 2:
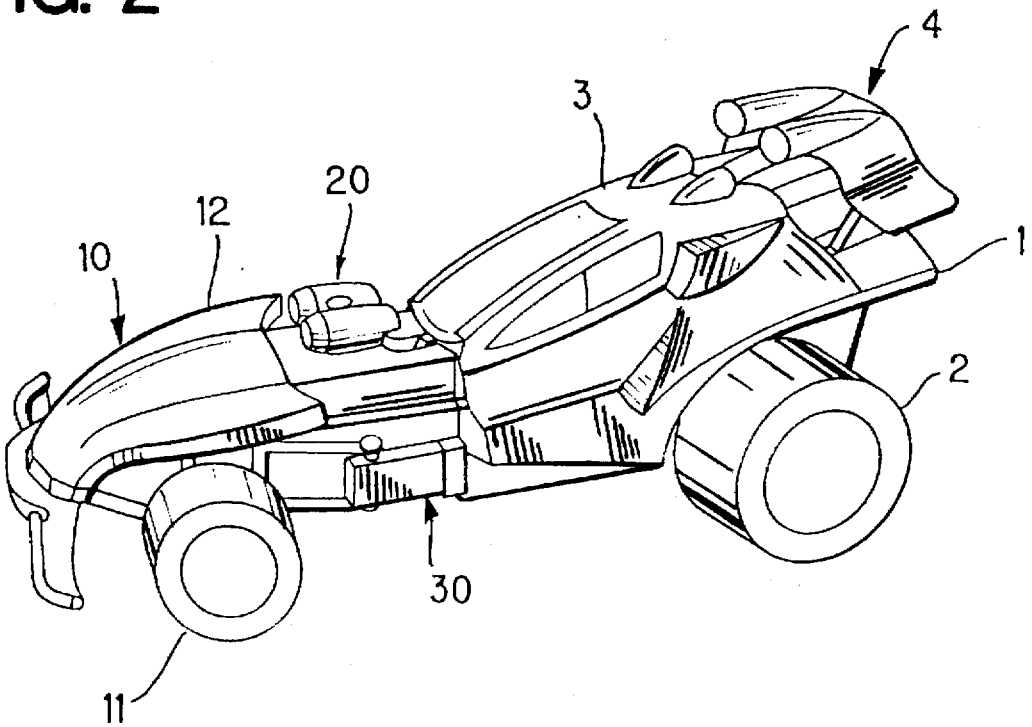
FIG. 2 is a perspective view showing a toy vehicle in the expanded condition in a first embodiment according to the invention.

FIGS. 1 and 2 are perspective views of the first embodiment of the toy vehicle according to the present invention, in which FIG. 1 shows the toy vehicle in its contracted condition and FIG. 2 shows the toy vehicle in its expanded condition. The toy vehicle of the first embodiment comprises a rear frame 1 being provided with rear tires 2 and a front frame 10 being provided with front tires 11, in which the front frame 10 is retractably mounted onto the rear frame 1 to permit the front frame 10 to move back and forth modifying the length of the toy vehicle from the contracted condition to the expanded condition or viceversa. The front and rear frames 10 and 1 are covered with front and rear covers 12 and 3. The rear frame 1 is provided with a tail spoiler 4 that can go up and down simultaneously with the back-and-forth movement of the front frame 10. The front frame 10 is provided with a model engine (hereinafter defined "engine") 20 that can go up and down simultaneously with the bask-and-forth movement of the front frame 10. Further, a model air-intakes (hereinafter defined "air-intake") 30 are provided between both sides of the front and rear frames 10 and 1, and can expand and contract simultaneously with the back-and-forth movement of the front frame 10.

When the front frame 10 is in the contracted condition, as shown in FIG. 1, and is then moved forward, the tail spoiler 4 and the engine 20 are sprung out of the rear and front framed 1 and 10 respectively and the air-intakes 30 are expanded, thus changing the toy vehicle into the expanded condition as shown in FIG. 2. When the front frame 10 is in the expanded condition, as shown in FIG. 2, and is then moved backward, the tail spoiler 4 and the engine 20 are retracted into the rear and front frames 1 and 10 respectively and the air-intakes 30 are also retracted, changing the toy vehicle into the contracted condition as shown in FIG. 1.

Figure 3:
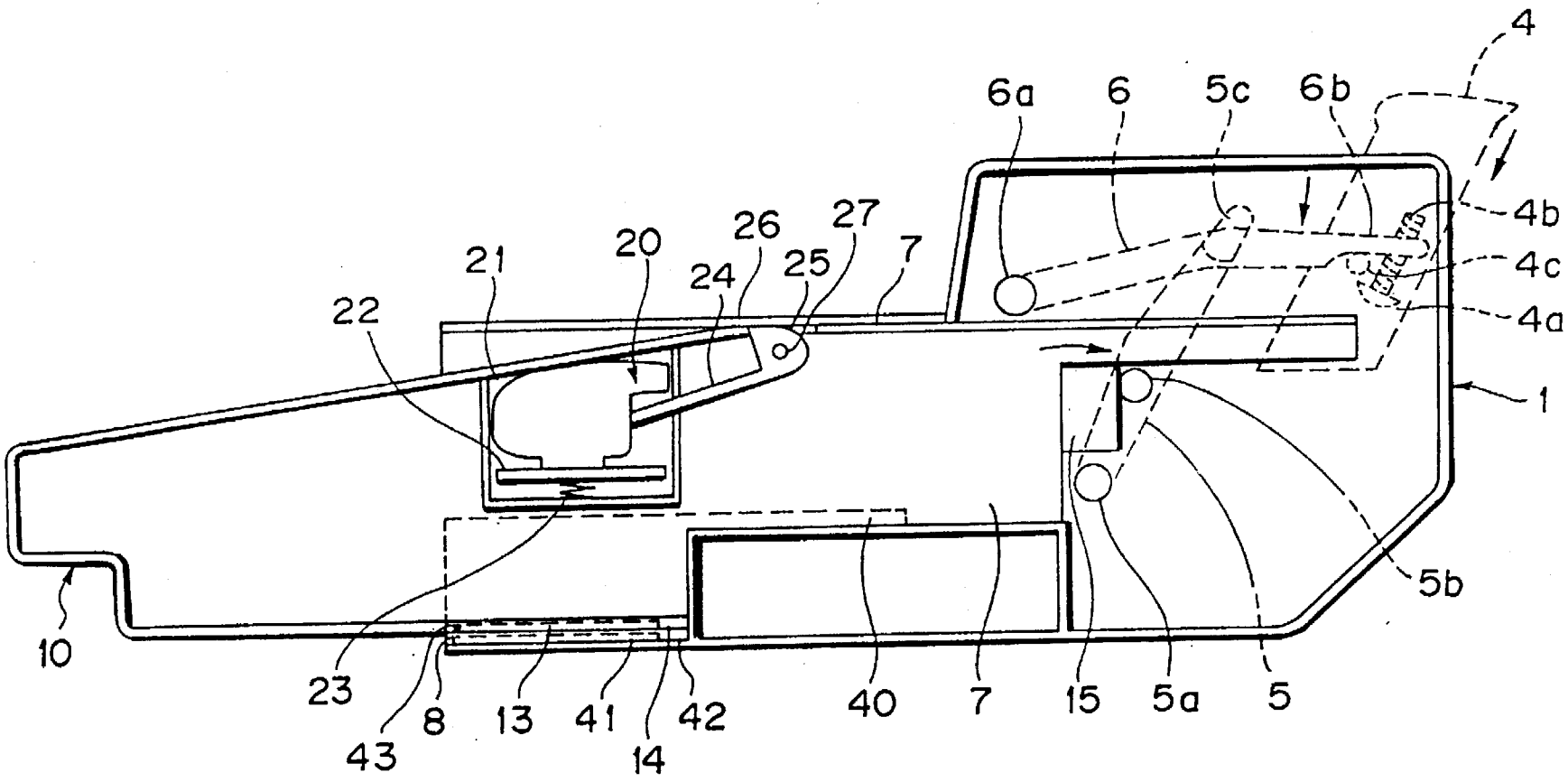
FIGS. 3 is a longitudinal cross sectional view showing a toy vehicle in the contracted condition in a first embodiment according to the invention.
Figure 4:
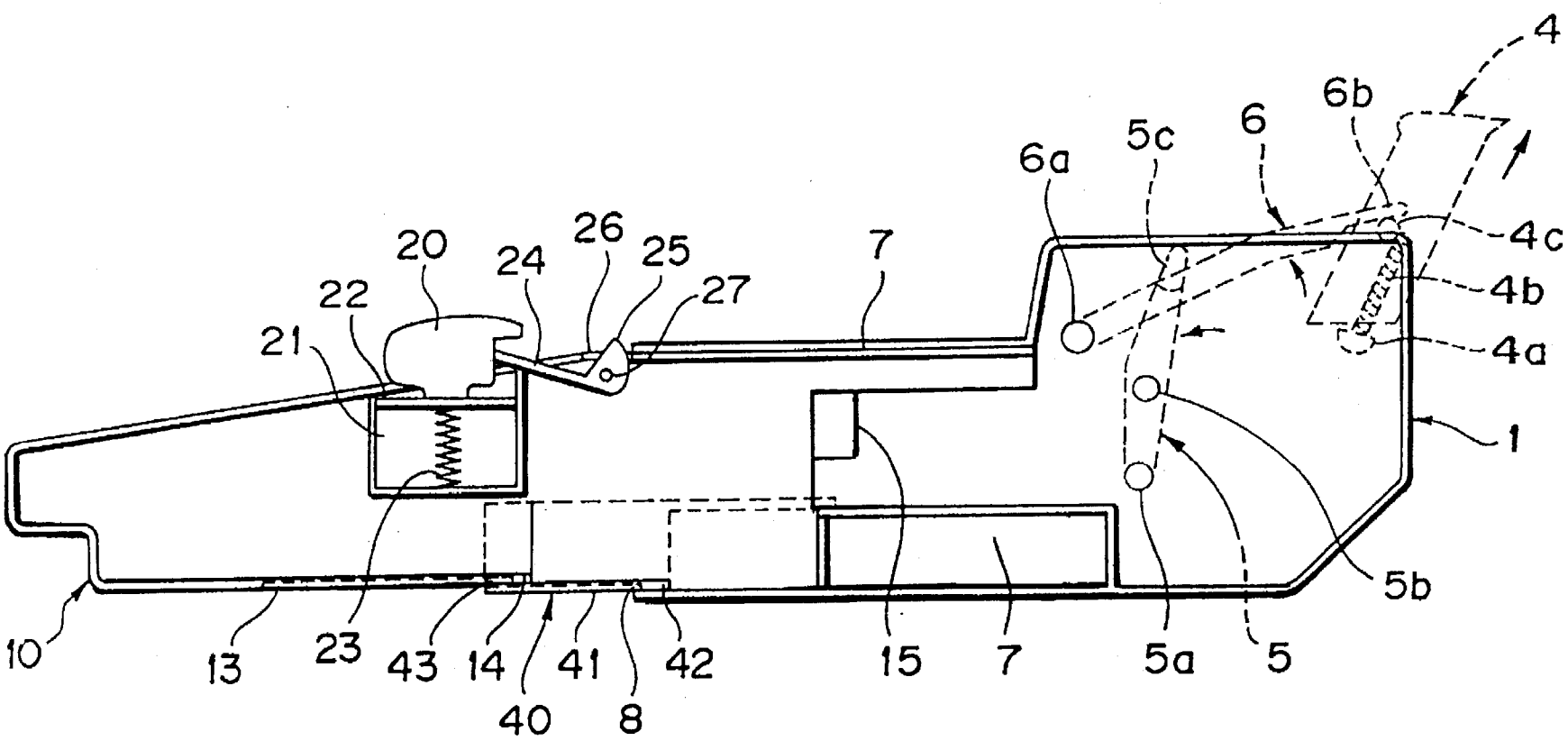
FIG. 4 is a longitudinal cross sectional view showing a toy vehicle in the expanded condition in a first embodiment according to the invention.
Figure 5:
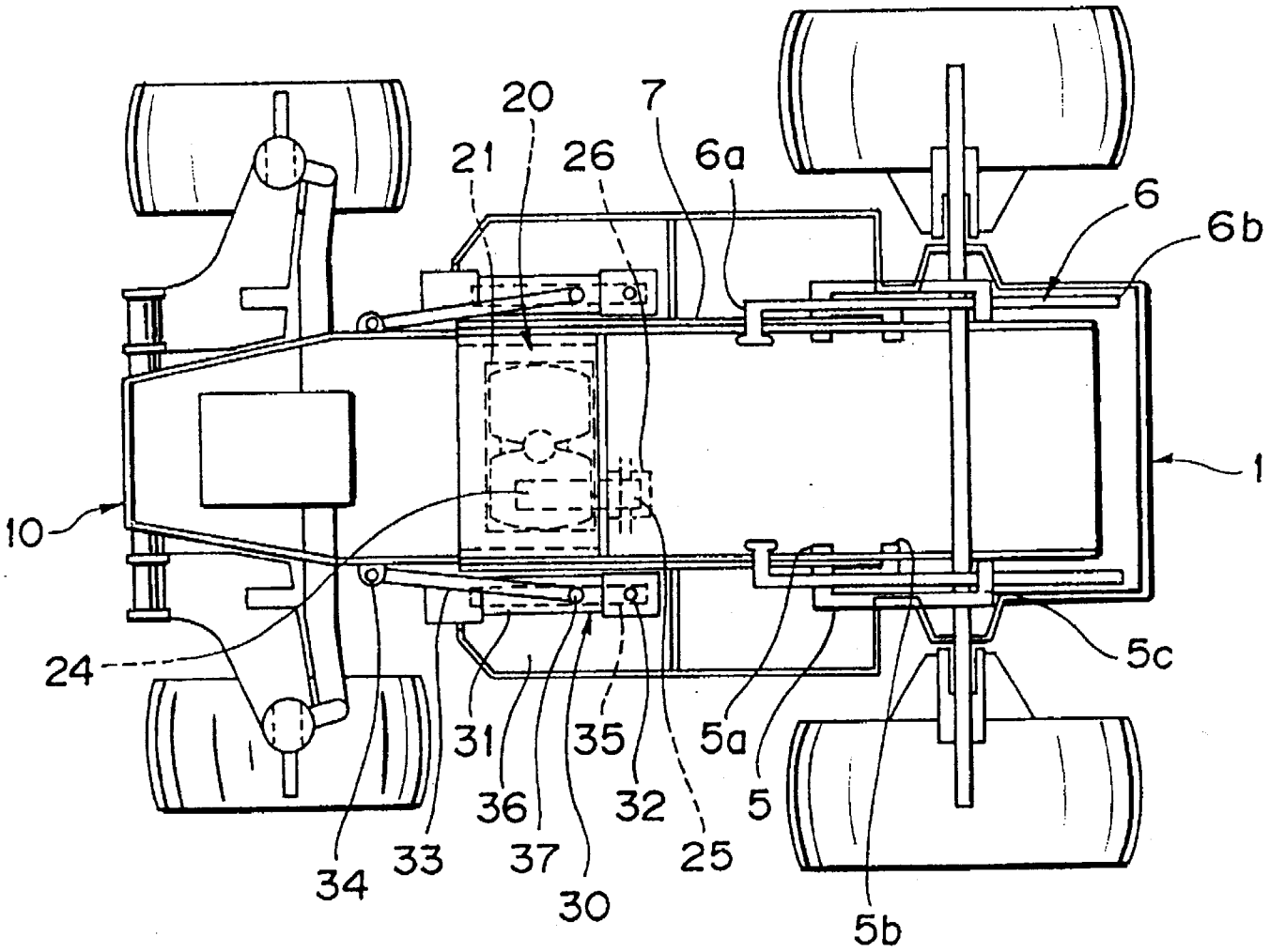
FIG. 5 is a transverse cross sectional view showing a toy vehicle in the contracted condition in a first embodiment according to the invention.
Figure 6:
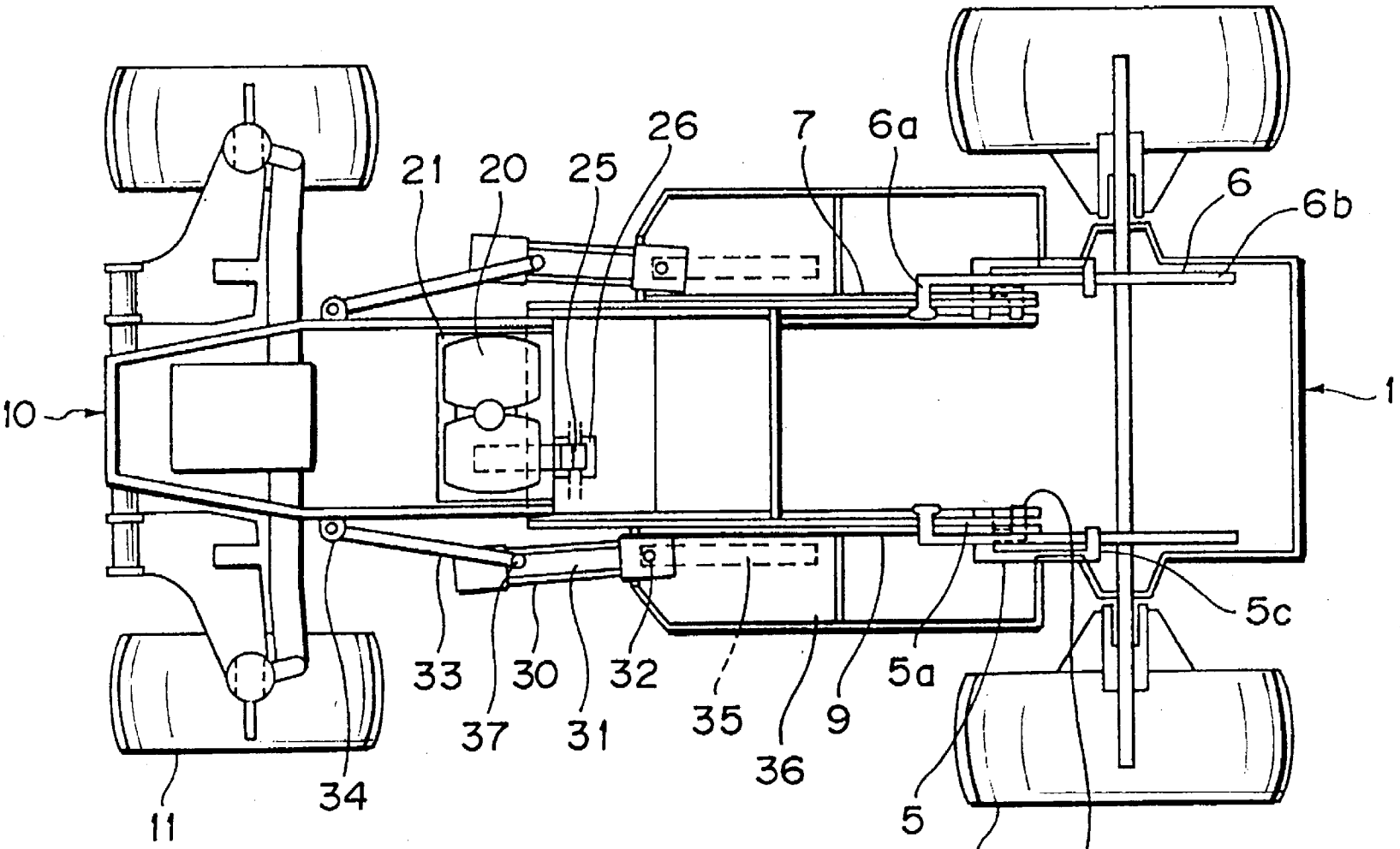
FIG. 6 is a transverse cross sectional view showing a toy vehicle in the expanded condition in a first embodiment according to the invention.

FIGS. 3 to 6 are cross sectional views of the toy vehicle as shown in FIGS. 1 and 2, in which FIG. 3 is a longitudinal sectional view of the toy vehicle shown in FIG. 1, FIG. 4 is a longitudinal sectional view of the toy vehicle shown in FIG. 2, FIG. 5 is a transverse sectional view of toy vehicle shown in FIG. 1 and FIG. 6 is a transverse sectional view of the toy vehicle shown in FIG. 2 respectively. For ease reference, the covers 3 and 12, and the tires 2 and 11 are not shown in FIGS. 3 and 4.

The rear frame 1 takes in the front frame 10 for a back and forth movement of the front frame 10 to change the toy vehicle from the contracted condition to the expanded condition or viceversa. Walls 7 beginning at the opening of the rear frame 1 act as guides for regulating the height and width of the front frame 10, and both sides of the front frame 10 slidably move on the walls 7 to change from the contracted to expanded condition or viceversa.

The front frame 10 is provided with an extension portion 40 at the bottom thereof. The extension portion 40 is allowed to move slidably on both the front and rear frames 1 and 10, thus being able to move the extension portion 40 forward from the rear frame 1 together with the movement of the front frame 10 as shown in FIGS. 3 and 4.

The rear frame 1 is provided with a stopper 8 at the bottom of its opening and the extension portion 40 is also provided with a groove 41 corresponding to the stopper 8 at its bottom. The stopper 8 comes in contact with a terminator 42 of the groove 41 to stop the movement of the extension portion 40 and thus prevent the extension portion 40 from coming out of the rear frame 1. A stopper 43 is also provided to the head of the extension portion 40, and a groove 13 corresponding to the stopper 43 is provided to the bottom of the front frame 10. The stopper 43 comes in contact with a terminator 14 of the groove 13 to prevent the front frame 10 from coming out of the rear frame 1.

The sides of the rear frame 18 are provided with first arms 5 and second arms 6 for making the tail spoiler 4 go up and down as described below. One end portion **5*a* of the first am 5 is pivotly attached to the side of the rear frame 1 to make the first arm 5 pivot on the one end portion 5*a* and the other end portion 5*c* is in contact with the second arm 6. The first arm 5 is also provided with protrusion 5*b* respectively which comes into contact with contact portion 15 being provided at the rear end of the front frame 10. One end portion 6*a* of the second arm 6 is also pivotly attached to the side of the rear frame 1 to make the second arm 6 pivot on the one end portion 6*a*, and the other end portion 6*b* is in contact with protrusion 4*c* being provided to two legs of the tail spoiler 4** which is described below.

The tail spoiler 4 provided to the rear portion of the rear frame 1 has two legs, each of which is attached to spring upward by use of elastic bodies **4*b* such as springs provided to support portions 4*a*. The protrusion 4*c* which are contacted by the end portions 6*b* of the second arms 6 is provided to the predetermined position of the legs of the tail spoiler 4**.

The front frame 10 is provided with an engine 20 for obtaining a changeable structure similar to the tail spoiler 4. With respect to the engine 20, the front frame 10 is provided with an engine chamber 21, in which the engine 20 is mounted on a support stand 22 through an elastic support member 23 such as a spring. The front frame 10 is provided with a third arm 24 for allowing the engine 20 to go up and down, one end of which is inserted into the engine 20 and another of which is pivotly attached to the front frame 10 through a rotation axis 27 provided to the front frame 10. The third arm 24 is provided with a contact portion 25 which is protruded from an opening 26 provided to the front frame 10. The contact portion 25 comes into contact with the front end portion of the rear frame 1 to take the tip portion of the third arm 24 down for the up-and-down motion of the engine 20.

The air-intake 30 is provided between the front and rear frames 10 and 1. The rear frame 1 is provided with chambers 36 for taking in the air-intakes 30 respectively. Long sideways opening 31 is provided at the center of the air-intake 30. One end portion 37 of connection member 33 is movably let to pass through the long sideways openings 31, and the other end portion 34 is attached to the front frame 10 respectively. Groove portion 25 are provided to the upper and lower walls of the chamber 36 and the end portion of the air-intake 30 is provided with protrusion 32 slidably moving in the groove portion 35. Further, the air-intake 30 acts as a stopper to prevent the front frame 10 from coming out of the rear frame 1.

Next, the movement of the toy vehicle of the first embodiment will be described below.

In the contracted condition as shown in FIGS., 3 and 5, the front frame 10 and the tail spoiler 4, the engine 20 are retracted into the rear frame 1 and the air-intake 30 is stowed in the predetermined position respectively as described above. At this time, the protrusion **5*b* provided to the first arm 5 is in contact with the contact portion 15 of the rear frame 1, in which the protrusion 5*b* is pushed in the backward direction of the rear frame 1 to prevent the tail spoiler 4 from springing out of the rear frame 1. Since the end portion 5*c* of the first arm 5 is in contact with the second arm 6, the second arm 6 pivot on the end portion 6*a* toward the bottom of the rear frame 1 simultaneously with the pivoting the first arm 5. The end portion 6*b* of the second arm 6 is thus in contact with the protrusion 4*c* to bring the tail spoiler 4 down against an elastic force of the elastic body 4*b* and to stow the tail spoiler 4 into the rear frame 1**.

The engine 20 is stowed in the engine chamber 21 inside of the front frame 10. Since the contact portion 25 provided to the third arm 24 is in contact with the wall 7 of the rear frame 1 through the opening 26, the third arm 24 pivots on the rotation axis 27 to facilitate the retraction of the engine 20 into the engine chamber 21 against an elastic force of the elastic support member 23 for stowing the engine 20 into the engine chamber 21.

The air-intake 30 is stowed into the chambers 36.

From the above condition, the front frame 10 is slidably moved on the rear frame 1 to change the toy vehicle from the contracted state as shown in FIGS. 3 and 5 to the expanded condition as shown in FIGS. 4 and 6.

When the front frame 10 is slidably moved forward, the contact between the contact portion 15 of the front frame 10 and the protrusion 5b of the first arm 5 is canceled. For this reason, the tail spoiler 4 is sprung out of the rear frame 1 due to the elastic force of the elastic bodies 4b. Then, when the front frame 10 is slidably moved forward continuously, a terminator 14 of the groove 13 provided to the bottom of the front frame 10 comes in contact with the stopper 43 of the extension portion 40, after which the extension portion 40 is also slidably moved together with the forward slidable movement of the front frame 10 for expansion of the toy vehicle. Subsequently, the engine 20 appears out of the inside of the rear frame 1. When the contact portion 25 of the third arm 24 go out of the wall 7, the engine 20 is sprung out of the front frame 10 by the elastic force of the elastic support member 23. In the air-intake 30, the connection member 33 is pulled out of the chamber 36 together with the slidable movement of the front frame 10, and the end portions 37 of the connection members 33 come in contact with the front end portions of the long sideways openings 31 to pull the air-intake 30 out of the chamber 36, in which the protrusion 32 are slidably moved in the groove portion 35. Finally, the terminator 42 of the groove 41 provided to the bottom of the extension portion 40 comes in contact with the stopper 8 provided with the rear frame 1 to stop the forward slidable movement of the front frame 10. This condition is shown in FIGS. 4 and 6.

On the other hand, for stowing the front frame 10 in the rear frame 1, the front frame 10 is slidably moved toward the inside of the rear frame 1. At this time, the contact between the termination portion 14 of the groove 13 of the front frame 10 and the stopper 43 of the extension portion 40 is canceled. Since the contact portion 25 of the third arm 24 comes in contact with the front end portion of the wall 7 in the rear frame 1 simultaneously with beginning the backward slidable movement of the front frame 10, the engine 20 is simultaneously stowed against the elastic force of the elastic support member 23 in the engine chamber 21 by pivot of the third arm 24. Then, the contact between the terminator 42 of the groove 41 in the extension portion 40 and the stopper 8 of the rear frame 1, is canceled, as a result of which the extension portion 40 is also slidably moved simultaneously with the backward slidable movement of the front frame 10 into the rear frame 1. At the air-intake 30, the end portion 37 of the connection member 33 is moved through the long sideways opening 31 in the backward direction, after which the protrusion 32 is slidably moved backward in the groove portion 35, thus stowing the air-intake 30 in the chamber 36. In addition, the contact portion 15 provided to the rear end portion of the front frame 10 comes in contact with the protrusion 5b of the first arm 5. As a result, the first arm 5 is pivoted on the end portion 5a in the backward direction of the toy vehicle for allowing the second arm 6 to pivot on the end portion 6a in the downward direction of the toy vehicle, thus stowing the tail spoiler 4 in the inside of the rear frame 1. The toy vehicle is changed into the contracted state as shown in FIGS. 3 and 5.

As described above, according to the first embodiment of the invention, since the rear frame 1 stows the front frame 10 which can be slidably moved on the rear frame 1, it is easy to extend or contract the length of the toy vehicle. Further, because the first and second arms 5 and 6, which move simultaneously with the front frame 10, are provided to the toy vehicle, it is easy to make the tail spoiler 4 go up and down simultaneously with the expansion-and-contraction movement of the toy vehicle with a simple structure. The engine 20 may also be made to go up and down simultaneously with the expansion-and-contraction movement of the toy vehicle on account of existence of the third arm 24.

In the first embodiment as described above, even if the front frame 10 is provided with the engine 20 and the rear frame I is provided with the tail spoiler 4, various modifications to the toy vehicle are possible. For instance, the tail spoiler 4 provided to the rear frame 1 may be replaced by the engine 20. In addition, the tail spoiler 4 and the engine 20 may be replaced by other items to be sprung out of the front and rear frames 10 and 1. Further, the front frame 10 is not slidably moved in the rear frame 1 but the rear frame i may be slidably moved in the front frame 10.

In the first embodiment, the front frame 10 is slidably moved into face contact with the wall 7 of the rear frame 1. If the toy vehicle of the first embodiment is made to run outside, it is possible that soil, dust and the like enter into the portion of a face in contact of the front frame 10 and the wall 7 of the rear frame 1. Therefore, protrusions or small wheels may be provided to the bottom of the front frame 10 for formation of point or line contact with the wall 7 of the rear frame 1 so that it is easy for the front frame 10 to move slidably against the soil or dust and to sweep it out of the toy vehicle.

A toy vehicle of a second embodiment according to the present invention will be described with reference to drawings. In the second embodiment, the same reference characters as the first embodiment are used to the same components of the first embodiment, to which the explanation will be omitted.

FIGS. 7 to 10 show cross sectional views corresponding to the FIGS. 3 to 6. In the second embodiment, the toy vehicle of the first embodiment is modified to a radio-controlled toy vehicle. The toy vehicle of the second embodiment has a first drive unit 50 to provide for the back and forth movement of the toy vehicle, a second drive unit 60 to provide for the back and forth slidable movement of the front frame 10 on the rear frame 1, a third drive unit 80 for steering the front tires 11, and a control unit (not shown).

The first drive unit 50 comprises a motor 51, a first gear 52 being provided to a rotation shaft of the motor 51, a second gear 53 being engaged with the first gear 52, a third gear 54 being provided to the same rotation shaft of the second gear 53, and a forth gear 55 being engaged with the third gear 54. The forth gear 55 makes a rotation shaft 56 of the rear tires 2 rotate.

For the connection of the front and rear frames 10 and 1, the second drive unit 60 is provided with, at the side of the rear frame 4, a motor 61, a first gear 62 being provided to a rotation shaft of the motor 61, a second gear 63 being engaged with the first gear 62 , a third gear 64 being provided to the same rotation shaft of the second gear 63, a forth gear 65 being engaged with the third gear 64, a fifth gear 66 being provided to the same rotation shaft of the forth gear 65, a sixth gear 67 being engaged with the fifth gear 66, a seventh gear 68 being provided to the same rotation shaft of the sixth gear 67. At the front frame 10 side, the second afire unit 60 is provided with a rack 69 being engaged with the seventh gear 68. In addition, the rear frame 1 side of the second drive unit 60 is provided with a switch 70 for stop of the rotation of the motor 61 by force when the length of the toy vehicle reaches the most expandable condition or the most contracted condition, and contact pieces 71 and 72 for contact with the switch 70.

The third drive unit (a steering unit) 80 comprises a well-known means.

Similar to the conventional radio-controlled toy vehicle, the toy vehicle of the second embodiment also has a power supply (not shown) for driving the motors and a radio transmitter (not shown) for transmission of a control signals. The control unit (not shown in FIGS. 7 to 10) is provided to the predetermined position of the front and rear frames 10 and 1 to receive the control signals for control of the first, second and third drive units 50, 60 and 80.

Figure 11:
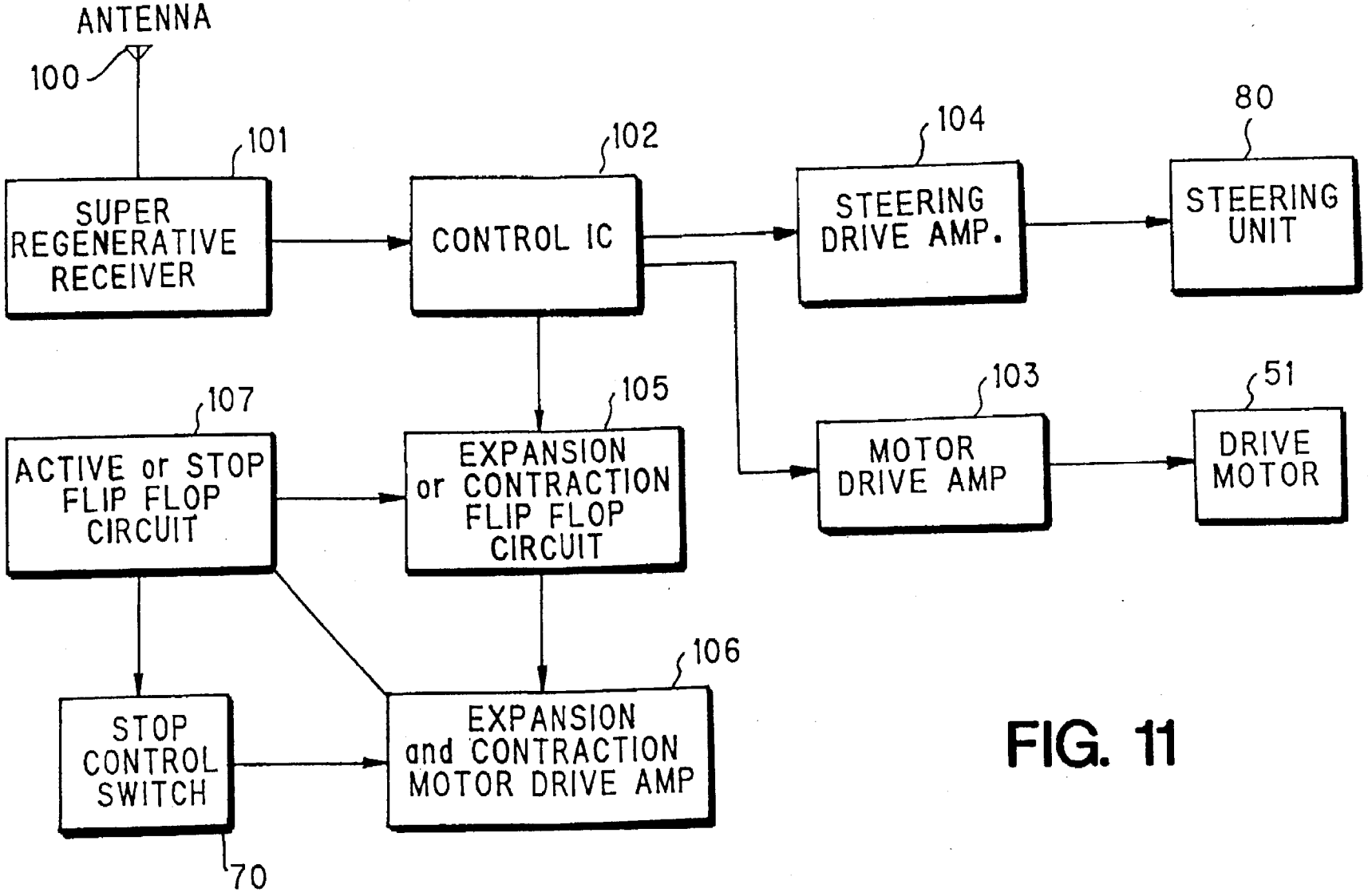
FIG. 11 is a block diagram showing a control unit of a toy vehicle in a second embodiment according to the invention.

FIG. 11 is a block diagram showing the control unit. The control unit comprises an antenna 100 for receiving the control signals from the radio transmitter, a super regenerative receiver 101, a control IC 102 for control of each of the drive units 50,60 and 80 in accordance with the control signals, a motor drive amplifier 103 for driving the motor 51 in accordance with a control signal from the control IC 102, a steering drive amplifier 104 for driving the steering unit 80 on the basis of the control signals from the control IC 102, an expansion or contraction flip flop circuit 105 for control of the back-and-forth movement of the front frame 10 according to the control signals from the control IC 102, an expansion and contraction motor drive amplifier 106 for driving the motor 61 for making the front frame 10 move slidably, and an active or stop flip flop circuit 107 for 61 in case of turning the switch 70 on.

Figure 12:
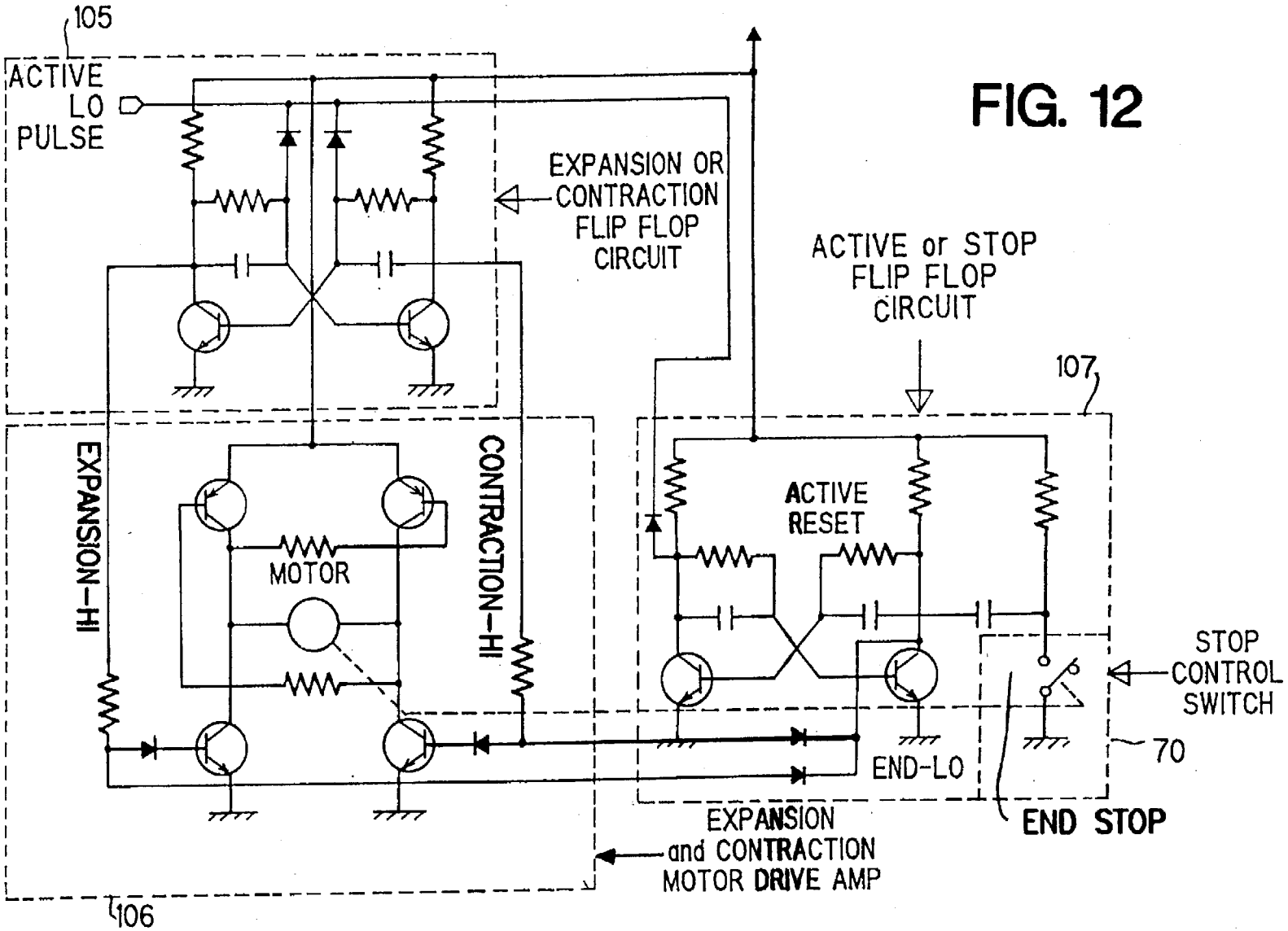
FIG. 12 is a circuit diagram showing a control unit of a toy vehicle in a second embodiment according to the invention.

FIG. 12 is a circuit diagram showing the control unit with respect to the expansion-and-contraction movement of the toy vehicle. The expansion or contraction flip flop circuit 105 is a flip-flop circuit comprising a bistable multivibrator, from which an expansion signal or a contraction signal is alternately outputted. The expansion and contraction motor drive amplifier 106 comprises a circuit using four transistors for switching the rotation direction of the motor 61 according to the expansion or contraction signals from the expansion or contraction flip flop circuit 105. The active or stop flip flop circuit 107 is a flip-flop circuit comprising a collector couple bistable multivibrator to stop the rotation of the motor 61 due to turning the switch on.

The movement of the toy vehicle of the second embodiment will described below.

Figure 7:
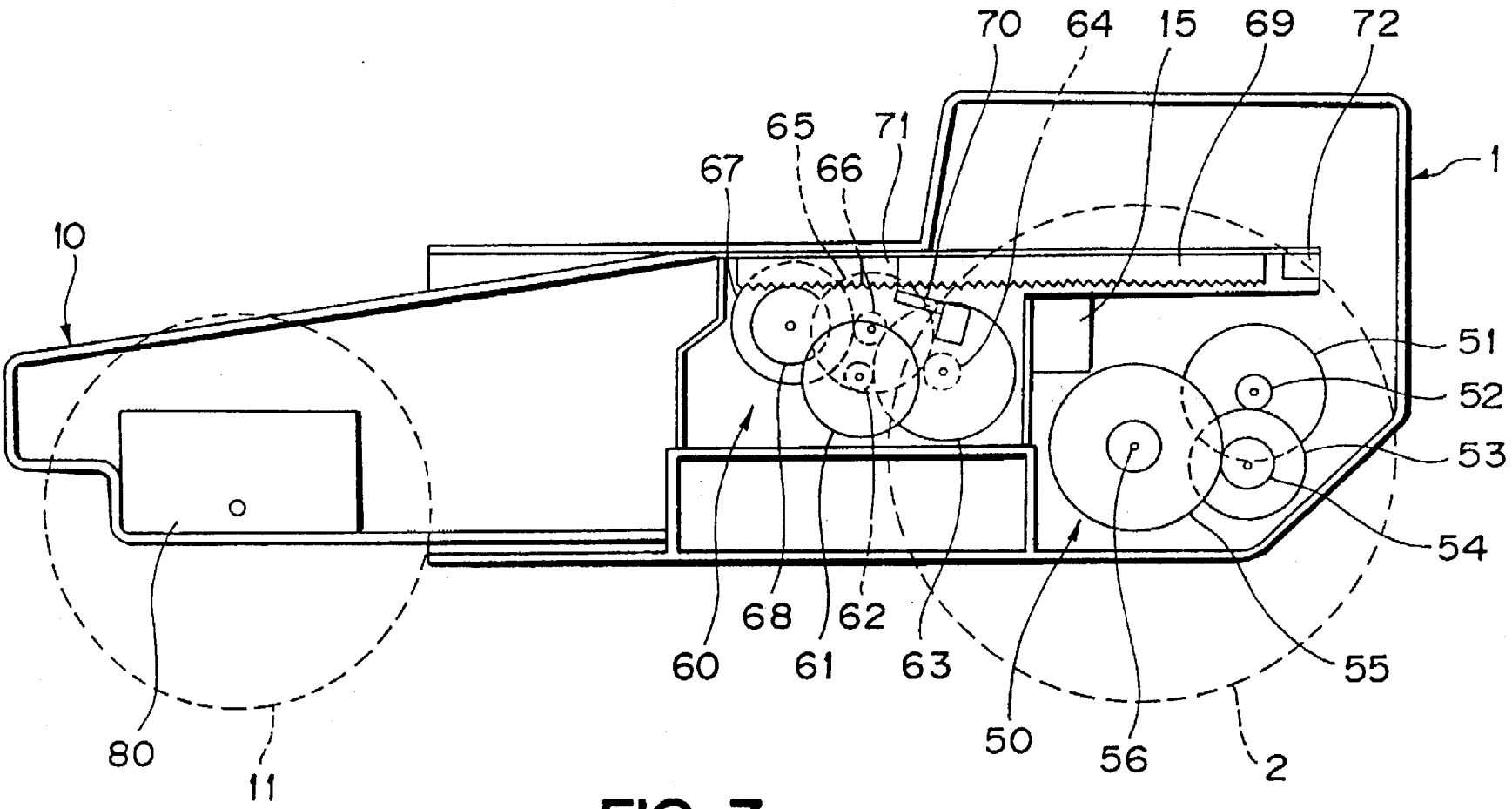
FIG. 7 is a longitudinal cross sectional view showing a toy vehicle in the contracted condition in a second embodiment according to the invention.
Figure 8:
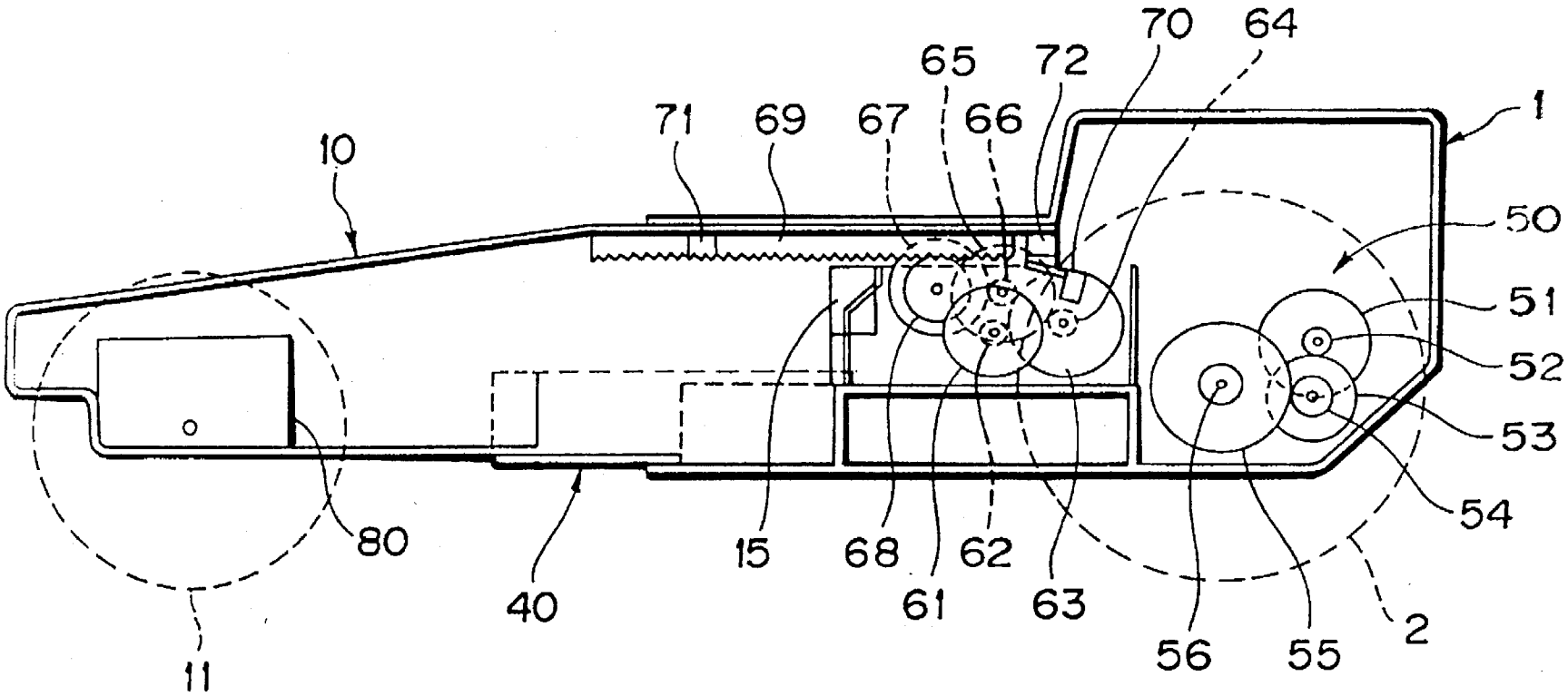
FIG. 8 is a longitudinal cross sectional view showing a toy vehicle in the expanded condition in a second embodiment according to the invention.
Figure 9:
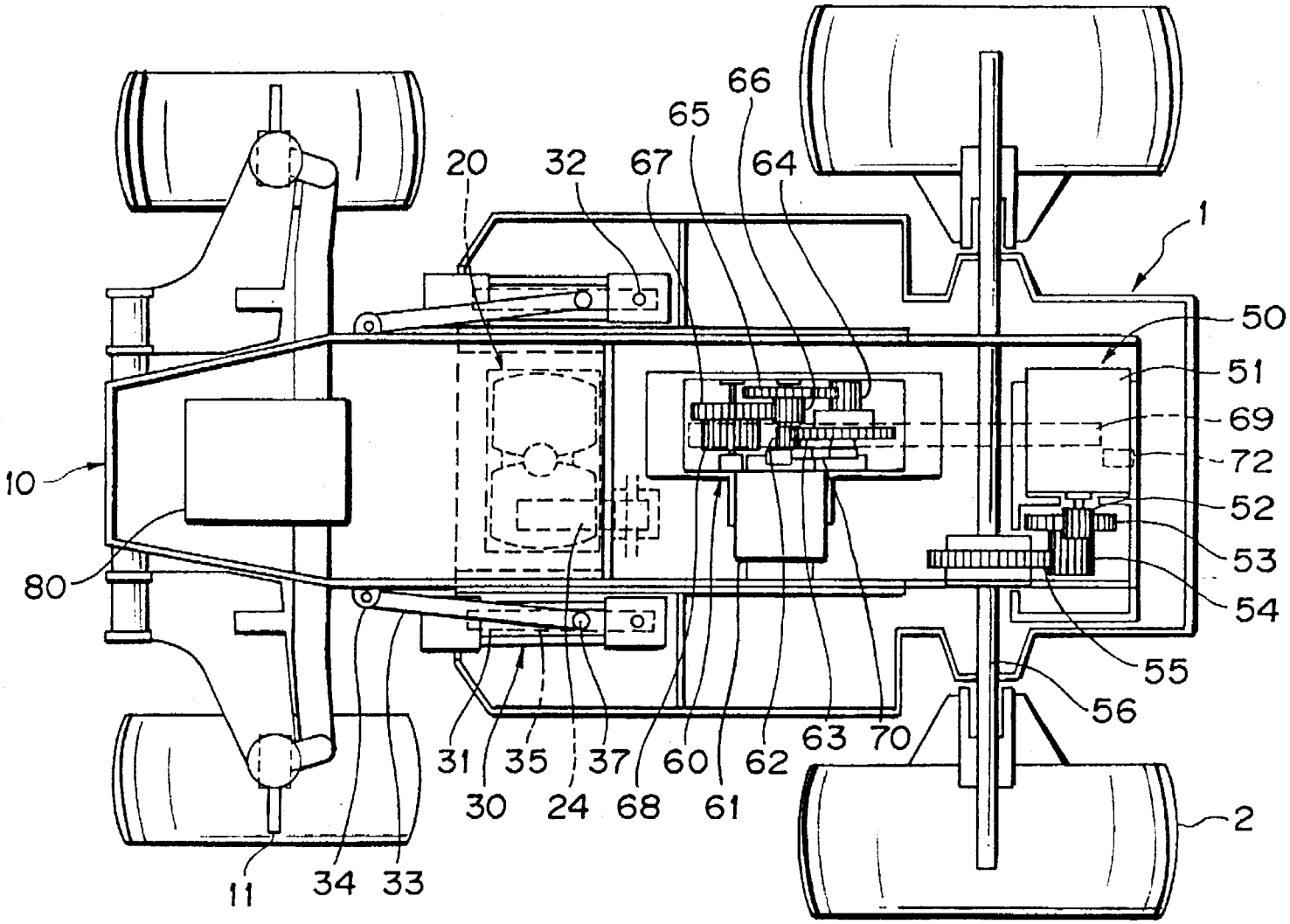
FIG. 9 is a transverse cross sectional view showing a toy vehicle in the contracted condition in a second embodiment according to the invention.
Figure 10:
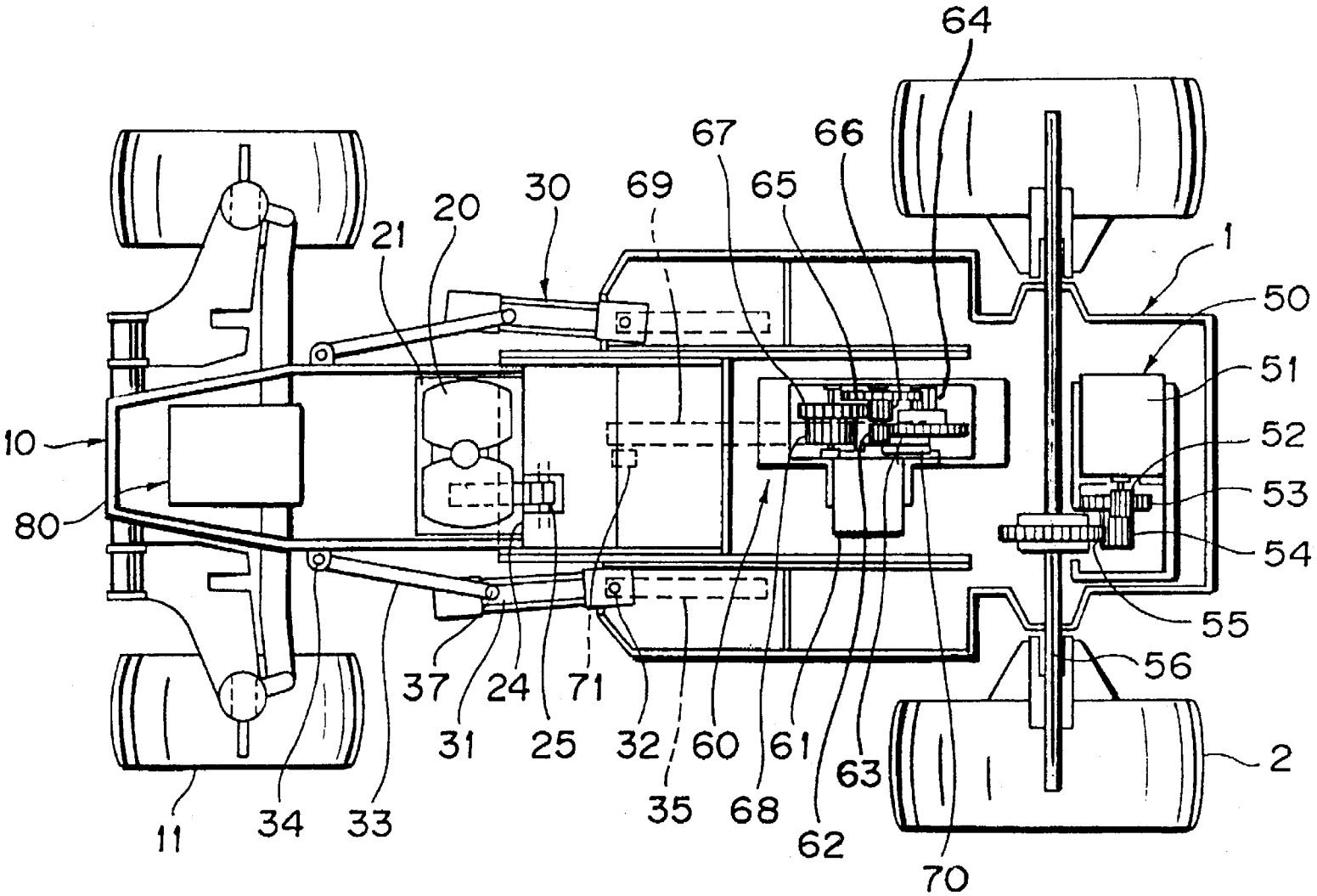
FIG. 10 is a transverse cross sectional view showing a toy vehicle in the expanded condition in a second embodiment according to the invention.

The toy vehicle is in the contracted condition as shown in FIGS. 7 and 9. General traveling and steering actions are carried out according to the control signals from the transmitter to control the motor 51 of the first drive unit 50 and the third drive unit (steering unit) 80 similar to the conventional radio-controlled toy vehicle.

The expansion movement is carried out as follows. It is possible to carry out the expansion movement regardless of whether the toy vehicle is in a traveling or a standstill condition. When the expansion signal is transmitted from the transmitter to the control unit, the expansion signal of the control IC 102 is supplied to the expansion and contraction motor drive amplifier 106 from the expansion or contraction flip flop circuit 105 for beginning of rotation of the motor 61. The first to the seventh gears rotate respectively by the rotation of the motor 61, and a rack 69 engaged with the seventh gear 68 is moved forward for the forward slidable movement of the front frame 10. Following this movement, the tail spoiler 4 and the engine 20 are sprung out of the front and rear frame 10 and 1 respectively and the air-intake 30 appear from the chamber 36. After that, when the switch 70 comes in contact with the second contact piece 72 to turn it on, the active or stop flip flop circuit 107 ceases to apply a voltage to the motor 61 for stopping the forward slidable movement of the front frame 10. Accordingly, the length of the toy vehicle can be expanded.

On the other hand, when a contraction signal is transmitted front the transmitter, the output signal of the expansion or contraction flip flop circuit 105 is changed into a contraction signal from the expansion signal, thereby reversing the rotation direction of the motor 61 by the expansion and contraction motor drive amplifier 106. Since the first to the seventh gears rotate in a reverse direction against their rotation direction of the expansion movement, the rack 69 engaged with the seventh gear 68 is moved backward for the backward slidable movement of the front frame 10 to be stowed into the rear frame 1. Following this movement, the tail spoiler 4, the engine 20 and the air-intake 30 are stowed into the front and rear frames 10 and 1 and the chamber 36 respectively. After that, when the switch 70 comes in contact with the first contact piece 71 to turn the switch 70 on, the active or stop flip flop circuit 107 ceases to apply a voltage to the motor 61 for stopping the backward slidable movement of the front frame 10. Accordingly, the length of the toy vehicle can be contracted.

If the toy vehicle in its expanded condition clashes against an obstacle, the front frame 10 may be forced inside of the rear frame 1 and may put pressure on the second drive unit 60, as a result of which teeth of the gears may be broken. To prevent this, a clutch structure is employed in the second and the third gears 63 and 64 in the second embodiment.

Figure 13A:
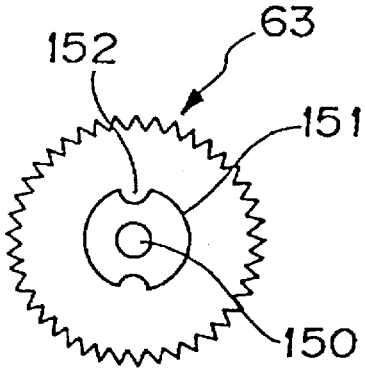
FIGS. 13A to 13C are plan views showing gears of a clutch structure used in a second drive unit in a second embodiment according to the invention.
Figure 13B:
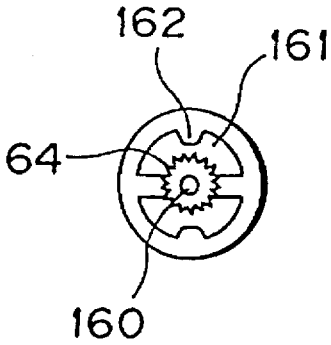
Figure 13C:
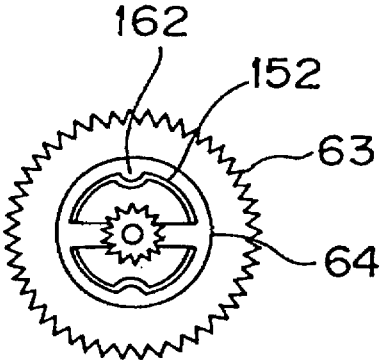

FIGS. 13A to 13C are plain views showing the above clutch structure, in which FIG. 13A shows the second gear 63, FIG. 13B shows the third gear 64 and FIG. 13C shows the clutch structure which is formed to couple the second and the third gears 63 and 64. The second gear 63 is provided with a disc-like convex portion 151 having a plurality of recess portion 152 around the disk-like convex portion 151. The third gear 64 is provided with a concave portion 161 corresponding to the disk-like convex portion 151 at the center axis 160 and the concave portion 161 is provided with protrusions 162 corresponding the recess positions 152 of the second gear 63.

For formation of the clutch structure, the disk-like convex portion 151 of the second gear 63 is fitted into the concave portion 161 of the third gear 64 and the protrusion 162 of the third gear 64 is fitted into the recess portion 152 of the second gear 63. Through the coupling of the protrusion 162 and the recess portion 152, the second gear 63 generally can transmit a rotation force to the third gear 64, and the third gear 64 also can transmit it to the other gears. When the toy vehicle clashes against an obstacle, a force due to the clash is added from the rack 69 to each gear and the motor 61 to make the front frame 10 stow into the rear frame 1. In this case, the protrusions 162 of the third gear 64 come off the recess portions 152 of the second gear 63 to rotate only the third gear 64 on the disk-like convex portion 151 of the second gear 63. According to this function, it is possible to prevent the gears from breaking and the motor 61 from being damaged when the toy vehicle clashes against an obstacle. In the second embodiment, even if this clutch structure is provided to the second and the third gears 63 and 64, the same effect can be obtained if the clutch structure is provided to the other gears.

As described above, in the second embodiment of the invention, since the first to the third drive unit are provided thereto, it is easy to obtain the back-and-forth, the turning movement and the expansion-and-contraction movement of the toy vehicle. The length of the toy vehicle in the expansion condition is changeable to adjust the length of the front frame 10, to provide a plurality of the extension portion 40 thereto and to adjust a length of the rack 69. Further, by expanding the toy vehicle when going straight, the stability of the toy vehicle while going straight can be improved because of the long wheelbase. By contracting the toy vehicle, the wheelbase is shortened and the stability of traveling in repeating continuous turning actions is improved.

Further, in the second drive unit 60, though the motor 61 and each gears are provided to the rear frame i and the rack 69 is provided to the front frame 10, the motor 61 and each gears may be provided to the front frame 10 and the rack 69 may be provided to the rear frame 1. In addition, for the up-and-down movement of the engine 20 and the tail spoiler 4, a gear combination structure is available.

Next, a modification of the second embodiment will be described below. In the second embodiment as described, although the front frame 10 is made to move slidably by a combination of the gear and the rack 69, this may be replaced by a feed screw (not shown). The feed screw is mounted on the rear frame 1 in direction of slidable movement of the front frame 10, in which the feed screw is connected through a gear to a motor for rotation. More than one gear may be provided between the feed screw and the motor and the clutch structure as described above may be included in the gears. While, the front frame 10 is provided with a female screw corresponding to the feed screw in which the feed screw is inserted into the female screw for coupling of the front and rear frames 10 and 1.

The front frame 10 can slidably be moved forward on the rear frame 1 for expansion of the length of the toy vehicle by rotation of the feed screw in the predetermined direction. On the other hand, the front frame 10 can slidably be moved backward on the rear frame 1 for contraction of the length of the toy vehicle by rotation of the feed screw in the opposite direction to the above.

As described above, in the second embodiment, any means for forward or backward slidable movement of the front frame 10, such as the combination of the gears and the rack, and the feed screw as well as air pressure is available. Even if the contact pieces 71 and 72 provided nearby both the end portions of the rack 69 for a detection of the position of the front frame 10, this may be replaced by optical detection means.

Although, the toy vehicle of the second embodiment operates by radio-control, this may be replaced by a wire-remote-control. In this case, a transmitter is connected to the control unit through a wire instead of using the antenna 100. Further, instead of the control unit of the second embodiment, a swatch simply turning the power source on or off may be available to drive the motor 61 of the second drive unit 60 for the expansion-and-contraction movement of the front frame 10. The motor 51 for the back-and-forth movement of the toy vehicle may also be controlled by a switch simply turning the power source on or off.

As described above, according the toy vehicle of the invention, since the front frame 10 is retractably mounted in the rear frame or viceversa, a toy vehicle which is retractable can be obtained very easily and with a simple structure. The retractable movement of the length of the toy vehicle can automatically carried out by the drive unit provided to the front and rear frames 10 and 1, to which the control unit may be provided for a radio or a wire remote control.

The front and rear frames 10 and 1 are provided with the tail spoiler 4 and engine 20 respectively to which the up-and-down movement means which operates together with the front frame 10 are connected. Therefore, the tail spoiler 4 and the engine 20 can be sprung out of the front and rear frames 10 and i when the front frame 10 moves for expansion of the length of the toy vehicle, while both can be stowed therein when the front frame 10 moves for contraction thereof. In addition, the wheelbase is changeable in the toy vehicle so that the stability of the toy vehicle while traveling is improved.

Whereas modifications of the present invention will no doubt be apparent to a person of ordinary skilled in the art to which the invention pertains, it is to be understood that the embodiments shown and described by way of illustration are by no means intended to be considered in a limiting sense. Accordingly, it is intended that the claims cover all modifications of the invention which fall within the spirit and scope of the invention.

What is claims is:

1. A toy vehicle comprising:

a front frame;

a plurality of front tires rotatably attached to said front frame;

a rear frame retractably mounted to said front frame, wherein said retractable mounting allows contraction and expansion action of said toy vehicle;

a plurality of rear tires rotatably attached to said rear frame;

a tail spoiler, said tail spoiler being movably attached to said rear frame; and means for moving said tail spoiler up and down with respect to said rear frame, comprising an elastic member, wherein said elastic member urges said tail spoiler away from said rear frame.

2. A toy vehicle according to claim 1, wherein said up and down movement means comprises a first arm, said first arm comprising a pivot end and a sweep end, wherein said pivot end is pivotally attached to said rear frame, and said sweep end is in contact with said tail spoiler, wherein pivoting of said first arm causes up and down movement of said tail spoiler.

3. A toy vehicle according to claim 2, further comprising two legs, said two legs extending from said tail spoiler and being movably attached to said rear frame, said two legs each comprising a protrusion disposed thereon, wherein said first arm is pivotally attached to a side of said rear frame, said sweep end of said first arm contacting one or both of said leg protrusions.

4. A toy vehicle according to claim 3, further comprising a second arm, said second arm comprising a pivot end and a sweep end, said pivot end of said second arm being pivotally attached to said rear frame, said sweep end of said second arm contacting said first arm between said pivot end and said sweep end of said first arm, wherein pivoting motion of said first arm causes pivoting motion of said second arm, causing up and down motion of said tail spoiler.

5. A toy vehicle according to claim 4, further comprising a protrusion disposed upon said first arm, wherein said first arm protrusion contacts said front frame, wherein said contraction and expansion action of said toy vehicle causes pivoting of said first arm.

6. A toy vehicle according to claim 2, further comprising a protrusion disposed upon said first arm, wherein said first arm protrusion contacts said front frame, wherein said contraction and expansion action of said toy vehicle causes pivoting of said first arm.

* * * * *